United States Patent [19]

Lashmore et al.

[11] Patent Number: 4,804,446

[45] Date of Patent: Feb. 14, 1989

[54] ELECTRODEPOSITION OF CHROMIUM FROM A TRIVALENT ELECTROLYTE

[75] Inventors: David S. Lashmore, Frederick, Md.; Ilan Weisshaus, Kiryat Bialik, Israel; Eok NamGoong, Changwon, Rep. of Korea

[73] Assignee: The United States of America as represented by the Secretary of Commerce, Washington, D.C.

[21] Appl. No.: 909,433

[22] Filed: Sep. 19, 1986

[51] Int. Cl.[4] ..... C25D 3/04

[52] U.S. Cl. ..... 204/51; 204/DIG. 2; 106/1.05

[58] Field of Search ..... 204/51, DIG. 2, 8, 9, 204/1; 106/1.05

[56] References Cited

U.S. PATENT DOCUMENTS

| | | | |
|---|---|---|---|
| 3,954,574 | 5/1976 | Gyllenspetz et al. | 204/43 T |
| 4,053,374 | 10/1977 | Crowther | 204/43 R |
| 4,054,494 | 10/1977 | Gillenspetz et al. | 204/51 |
| 4,141,803 | 2/1979 | Barclay et al. | 204/51 |
| 4,161,432 | 7/1979 | Barclay et al. | 204/51 |
| 4,184,929 | 1/1980 | Tomaszewski et al. | 204/51 |
| 4,196,062 | 4/1980 | Barclay et al. | 204/36 |
| 4,293,620 | 10/1981 | Vigar | 428/667 |
| 4,461,680 | 7/1984 | Lashmore | 204/41 |
| 4,543,167 | 9/1985 | Seyb et al. | 204/51 |

OTHER PUBLICATIONS

"Cr III Baths—" Datta, Galvanotechnik 73:4, 106–112 1982.

J. E. Bride, "Low Valence Decorative Chromium Plating", Nov., 1972 pp. 1027–1032.

J. C. Crowther and S. Renton, "Recent Developments in Trivalent Chromium Plating".

"Electrodeposition of Chromium from Chromium (III) Chloride Hexahydrate-n-Propanol Baths", by Toshiaki Tsuru et al., vol. 33, No. 4, 1982, pp. 140–145.

"Complex Species in Aqueous and Alcoholic Solutions of Chromium (III) Cloride Hexahydrates", by Toshiaki Tsuru et al., vol. 33, No. 12, 1982, Pages 608–613.

"Electrodeposition of Chromium from Chromium (III) Chloride Hexahydrate in Different Organic Solvents", by Toshiaki Tsuru et al., vol. 34, No. 1, 1983, pp. 12–18.

*Primary Examiner*—R. L. Andrews

*Attorney, Agent, or Firm*—Thomas Zack; Alvin Englert; James A. Oliff

[57] ABSTRACT

An electrodeposition process and a bath therefore are disclosed for performing the electrodeposition of hard smooth coatings of trivalent chromium. The electrodeposition process is accomplished energy efficiently. The bath includes chromium chloride as a source of chromium, citric acid to complex the chromium, and a wetting agent which is preferably Triton x-100. Preferably, bromide is also provided in the solution to maintain the hexavalent chromium production at the anode at a low level. Ammonium chloride is also preferably provided to improve the conductivity and also the current distribution in the bath. Boric acid is provided to advance the reaction kinetics. The pH of the bath is maintained at approximately 4.0 and the temperature is maintained at approximately 35° C. Either a direct current or pulsed current is used for the deposition process. Hard smooth coatings of trivalent chromium are deposited through use of the process and the bath of the claimed invention.

24 Claims, 8 Drawing Sheets

A 20°C-30 A/dm$^2$
B 30°C-30 A/dm$^2$
C 40°C-30 A/dm$^2$
D 40°C-40 A/dm$^2$
E 40°C-50 A/dm$^2$

A 20°C-30 A/dm$^2$
B 30°C-30 A/dm$^2$
C 40°C-30 A/dm$^2$
D 40°C-40 A/dm$^2$
E 40°C-50 A/dm$^2$

ELECTRODEPOSITION OF CHROMIUM FROM A TRIVALENT ELECTROLYTE

BACKGROUND OF THE INVENTION

The present invention relates to the deposition of chromium onto other metals. The use of chromium electrodeposited onto other metals is a well established industrial practice because of the wide need for the superior wear and corrosion resistance provided by chromium coated surfaces.

In the past chromium coating was achieved by the deposition of hexavalent chromium. This provided for hard, smooth coatings of chromium. However, undesirable waste products are created by the process of coating with hexavalent chromium and the hexavalent chromium coating process is energy inefficient.

There is a need for a coating system which provides the properties of hard chromium without the waste treatment problems or physical hazards associated with the deposition processes for hexavalent chromium.

Trivalent chromium deposits in the past have had a slightly darker appearance and have been softer than the hexavalent chromium coatings. Thick chromium coatings with hard wear resistant surfaces were not available from trivalent processes.

Trivalent chromium can not be plated directly in a simple electrolyte but requires highly complex systems with coordinating ligands including water and complexes. Chromium chloride has three kinds of complexes: $[Cr(OH_2)_4Cl_2]Cl.2H_2O$ in the green form; $[Cr(OH_2)_5Cl]Cl_2.H_2O$ in the blue-violet form; and $[Cr(OH_2)_6]Cl_3$ in the violet form. Dissolution of these forms in water gives an equilibrium mixture of the tetra, penta and hexa aqua complexes. The exact composition is dependent on pH, temperature and concentration. The equilibrium of these complexes is slow.

SUMMARY OF THE INVENTION

This invention was developed in view of the foregoing background and to overcome the foregoing drawbacks.

It is accordingly an object of the present invention to provide an electrodeposition process for the electrodeposition of hard smooth coatings and a bath for performing this process.

It is a further object of the present invention to provide a method and a bath for depositing hard smooth coatings of chromium which is energy efficient.

To achieve these objects a chromium chloride bath is provided which includes chromium chloride as a source of chromium, citric acid to complex the chromium, and a non-sulfur containing wetting agent (preferably Triton X-100). Preferably, bromide is also provided in the solution to keep the hexavalent chromium production at the anode low. Ammonium chloride is preferably provided to improve the conductivity and also the current distribution in the bath. Boric acid is also preferably provided to advance the reaction kinetics. The bath is preferably free of sulfur containing salts.

The pH of the bath is maintained at between 1.8 and 4.9 and preferably at pH=4.0 ±0.5 using formic acid as a buffer. The temperature of the bath is maintained at between 20 and 50° C. and preferably at 35° C.±10° C.

A trivalent chromium coating is deposited by either a direct current (galvanostatic deposition) in the range of approximately 200–500 mA/cm$^2$ or by pulsed galvanostatic deposition at approximately 500 mA/cm$^2$ peak at 250 μs on and 750 μs off, however, a broad range of conditions exist at which good coatings can be obtained. Preferably, the pulsed current is applied.

BRIEF DESCRIPTION OF THE FIGURES

The above objects, features and advantages of the present invention will become more apparent from the description of the invention which follows, taken in conjunction with the accompanying drawings, wherein like reference numerals denote like elements, and wherein.

DETAILED DESCRIPTION OF THE PREFERRED EMBODIMENTS

Figure 1:
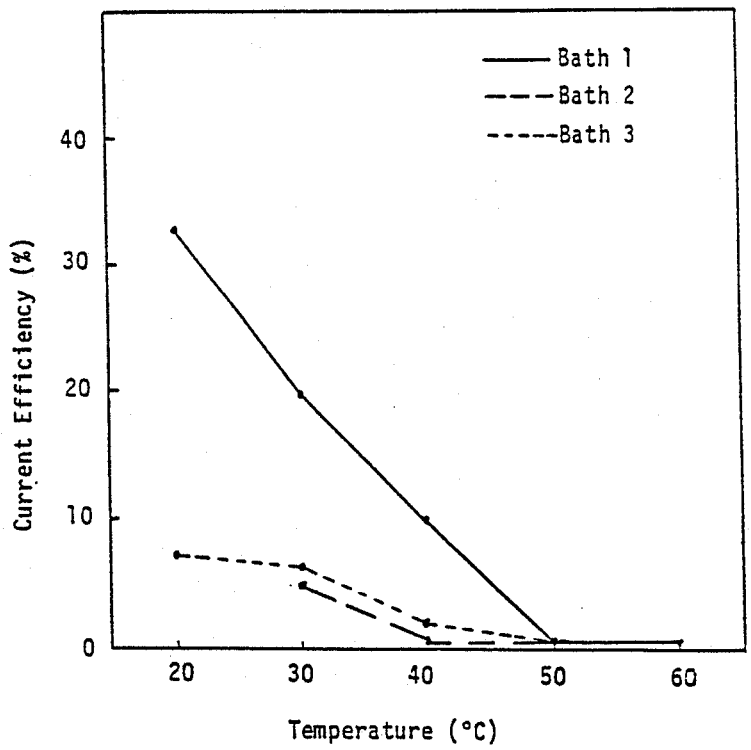
FIG. 1 is a graph showing the change in current efficiency with the change in temperature for baths having three different compositions.

The following detailed description of the invention illustrates a preferred embodiment according to the present invention.

An electroplating bath is provided which contains chromium in solution. The chromium is preferably provided in the form of $CrCl_3.6H_2O$ at a concentration of between 50–150 g/l of solution. The preferred concentration is approximately 100 g/l of solution. The bath further comprises a complexing agent which is preferably either gylcolic acid at a concentration of between 25 and 50 g/l or sodium citrate at a concentration of between 30 and 100 g/l. Sodium citrate at a concentration of approximately 80 g/l is preferred. Glycolic acid is not as desirable since it causes an anodic decomposition product. The complexing agent forms complexes with the chromium ions. Borate is also preferably included in the bath in the form of $H_3BO_3$ at a concentration of between 20 and 40 g/l but preferably at a concentration of approximately 40 g/l.

An alkali halide and/or amonium halide is also preferably added to the electroplating bath. Bromide is the most preferable of the alkali halides. An advantageous way to add bromide is in the form of KBr at a concentration of between 5 and 20 g/l. However, fluoride or fluoride ions also may be used. The halide functions to deoxidize and to be released at the anode. Without the halide a certain percentage of the chromium will be oxidized from the trivalent to the hexavalent state. The halide therefore functions to reduce the amount of hexavalent chromium at the anode.

A wetting agent is also employed. Preferably, this wetting agent is a non-sulfur containing nonionic surfactant such as polyethylene glycol ethers of alkylphenols, such as Triton X-100 (registered trademark of Rohm and Haas Company). The wetting agent is important because it ensures that the size of the hydrogen bubbles are small so that they do not stick to the surface of the anode and block the reaction. The wetting agent is preferably added in a concentration of approximately 1 to 2 drops /1.

A buffer is preferably employed to maintain the pH of the solution at 4.0±0.5. Formic acid is a convenient buffer which is readily available. Formic acid is generally employed at between 5 and 75 g/l.

The coating can be deposited by direct current (galvonostatic deposition) which is applied in the range of approximately 200–500 mA/cm$^2$. Preferably, however, the current is deposited by pulsed galvonostatic current applied at approximately 500 mA/cm$^2$. The pulsed galvonostatic deposition peaks at 250 μs on and 750 μs off. However, a broad range of conditions exist over which good coatings can be obtained.

The pulsed current is found to have important advantages over the direct current deposition such as reducing hydrogen films which can block the current and halt the reaction. Using pulsed current for the electrodeposition thereby helps to provide smooth crack-free surfaces and corrosion-resistant coatings.

The process of this invention provides thick coatings of chromium. Prior art processes for the deposition of trivalent chromium yield coatings of less than 20 microns. The process of this invention, on the other hand, can yield coatings which are not limited in thickness, e.g., coatings of greater than 125 microns have been produced. The hardness of the coatings produced have been found to be in excess of 700Vhm$_{50}$. The coating produced is crack-free and the corrosion performance in 3.5 wt %, sodium chloride (see the data from the examples) is good. The appearance of the coating is similar to chromium deposited from an electrolyte containing hexavalent chromium ion.

The invention is additionally illustrated in connection with the following examples which are to be considered as illustrative of the present invention. It should be understood, however, that the invention is not limited to the specific details of the examples.

EXPERIMENTAL EXAMPLES

Plating Cell

Plating was carried out in a 3L beaker and electrolytes were made up from reagent grade chemicals and distilled water. Electrolyte compositions are shown in Table 1. Two types of platinum anodes were used, a cylinder-screen for steel ball cathodes and a platinum sheet for flat copper panel cathodes. Temperature was controlled with ±2° C. and agitation of the electrolyte was achieved by means of a hot plate-magnetic stirrer arrangement.

TABLE 1

Trivalent chromium bath compositions.

| Chemicals | | 1 | 2 | 3 |
|---|---|---|---|---|
| $CrCl_3.6H_2O$ | (g/l) | 100 | 100 | 100 |
| KBr | (g/l) | 15 | 15 | 15 |
| $H_3BO_3$ | (g/l) | 40 | 40 | 40 |
| HCOOH | (ml/l) | 30 | 30 | 30 |
| Triton X-100 | (drop/l) | 1 | 1 | 1 |
| Glycolic Acid | (g/l) | 32 | 32 | — |
| Sodium Citrate | (g/l) | — | 94 | 94 |

Except for the current efficiency study, bath 1 was selected as the basis for the work reported here. The temperature was adjusted to 20°–50° C. and current density to 30–50 A/dm$^2$. The pH was held constant at 1.5.

Specimen Preparation

It was necessary to prepare two kinds of specimens as described above. These were 52,100 steel balls for the abrasive wear testing and 14 mm×28 mm×1 mm thick copper panels for scanning electron microscopy [SEM], microhardness testing and optical metallography.

Before plating, the steel balls were connected to Ni-Cr wire by spot welding and degreased in solvent, rinsed, electroetched in 30 v/o $H_2SO_4$, rinsed, plated in a Woods nickel electrolyte at 3A/dm$^2$ for 3 minutes, rinsed and then plated in a trivalent chromium bath to a coating thickness of about 50 μm.

Copper panels were polished with metal polish, degreased, rinsed and then plated to a thickness of about 50 μm for the microhardness and optical metallography and to about 15 μm for SEM microstructure observation.

Testing and Structure Observation

The micro (Vickers) hardness measurements were carried out at a load of 50 g and 400x magnification on the cross-section of 50 μm thick coatings. The values reported are averages of 10 measurements.

The surface structures of as-plated chromium were observed by SEM at a magnification of 1000X and cross sections were studied by optical microscopy after etching in 20 volume percent HCl at 60° C. for 15 sec to 1 minute at a magnification of 1000X.

Powder X-ray diffraction was used to investigate crystal structure, orientation and the grain size of the deposits. Each specimen was reported from values of 34° to 140° in increments of 2° and measured with CuKa with a Mn filter.

A modified abrasive wear tester was used for testing the properties of chromium deposits. An abrasive slurry, consisting of 5μm $Al_2O_3$ (10g) and fumed silica (5g) mixed with water and adjusted to pH=4.0 using ferric chloride, was used in this testing instrument. The wear cycle was 400 rpm, corresponding to an average speed of 40 cm/second. The initial load on the ball specimen was 4.4. The weight loss was determined on a microbalance with an accuracy of $\pm 10^{-3}$ mg by mass difference before and after testing. The current efficiency was calculated from the mass gain determination before and after plating.

In order to investigate the effect of mass transport on the deposition process a potentiostatic study was carried out at 40±2° C. and 2.5V with respect to SCE (Saturated Calomel Electrode) with a rotating disk electrode as the cathode. The speed of this rotating platinum electrode was 200 rpm. A platinum sheet was used as the counter electrode.

RESULTS AND DISCUSSION

Current Efficiency

The reactions occurring at the cathode are chromium deposition and evolution of hydrogen gas. The cathodic current efficiency of chromium is the ratio of current producing chromium $I_{Cr}$ to the applied current $I_{tot}$ which $I_{tot}$ is equal to $I_{Cr}+I_{H2}$.

The effect of temperature on current efficiency of trivalent chromium for the various solutions is shown in FIG. 1. The current efficiency decreases with increasing temperature for all three of the electrolytes considered here. These results indicate that at the higher temperature, Cr(III) is complexed more strongly by either glycolate or citrate ion. An alternative explanation for these results may be that hydrogen always deposits below its limiting current. However, the chromium is mass transport limited. As the temperature increases it would normally (if chromium were not mass transport limited) be expected that both the rate for deposition (evolution) of hydrogen and of chromium would increase. However, unless the mass transport of chromium is increased only the hydrogen deposition (evolution) would increase and so current efficiency for the deposition of chromium would decrease.

In the trivalent electrolyte the chromium chloride forms complexes with coordinating ligands including water and the complexing agent. In the green form of the electrolyte the chromium is bonded with 4 water molecules and in the violet form with 6 water molecules. The energy to dehydrate these ligands results in a further increase (more cathodic or negative) in the potential necessary for the reduction of chromium to metal. Therefore the violet form needs more energy than the green form because there are 6 molecules of water to remove.

The glycolic acid bath in blue-green form has a higher current efficiency than the citrate-based bath. Hence, the energy required to break the bonding and to deposit chromium in glycolic electrolytes is less than that of citrate-based processes. That is, the citrate forms a stronger complex than the glycolic acid.

Figure 2:
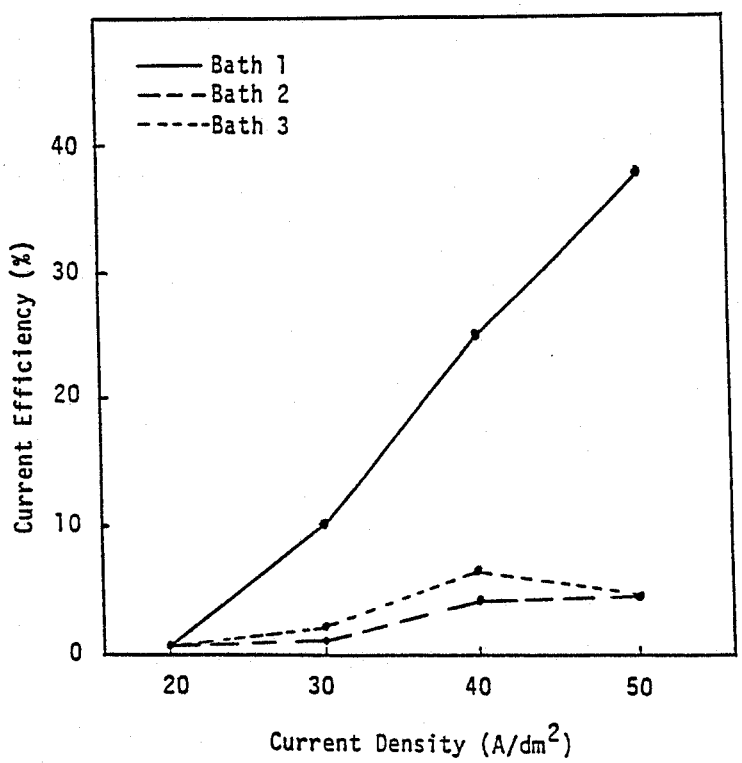
FIG. 2 is a graph showing the change in the percentage of current efficiency with the change in current density for three different baths having different compositions.

The effect of current density on the current efficiency for deposition of trivalent chromium from the various solutions investigated here is shown in FIG. 2. The current efficiency increases with current density. These results can be explained in the following way. As the current density increases, then the pH in the vicinity of the cathode also increases. In the case of citrate alone, this results in an increase in the degree of complexation, but in the case of glycolic acid alone, any increase in the degree of complexation is overcome by the decrease in the rate of hydrogen evolution with increasing pH. In the case of the mixed electrolyte (Bath 2), most of the chromium seems to be tied up with citrate (94 g/l citrate, 32 g/l of glycolic acid) therefore the current efficiency would be expected to be similar to that of Bath 3 (pure citrate). This is verified in FIG. 2.

Morphology and X-ray Diffraction Study of Deposits

Figure 3A:
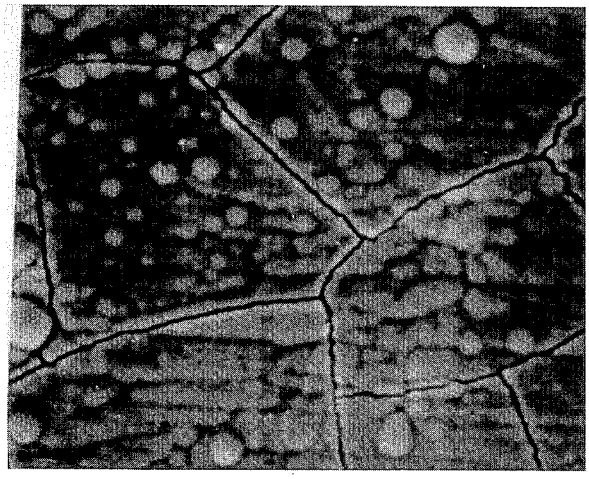
FIG. 3*a* shows the SEM microstructure (X1000) of trivalent chromium as deposited at a bath temperature of 20° C. and a current density of 30 A/dm$^2$.
Figure 3D:
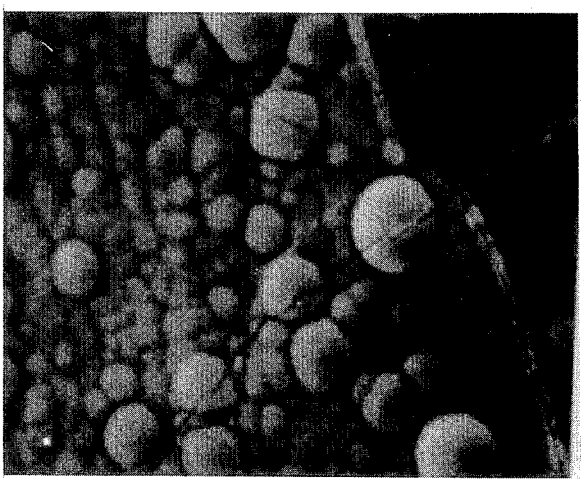
FIG. 3*d* shows the SEM microstructure (X1000) of trivalent chromium when deposited at a bath temperature of 40° C. and a current density of 40 A/dm$^2$.
Figure 3B:
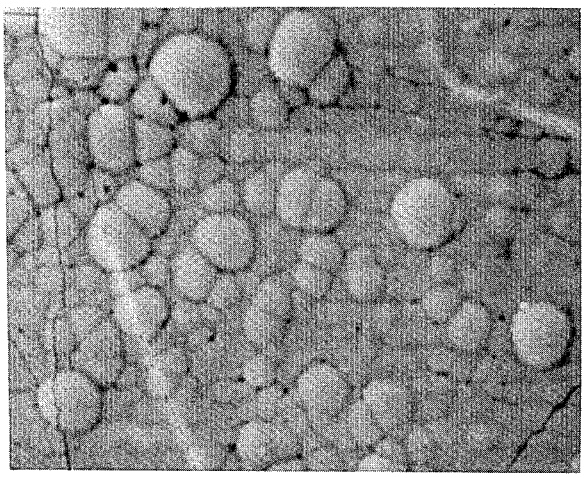
FIG. 3*b* shows the SEM microstructure (X1000) of trivalent chromium as deposited at a bath temperature of 30° C. and a current density of 30 A/dm$^2$.
Figure 3E:
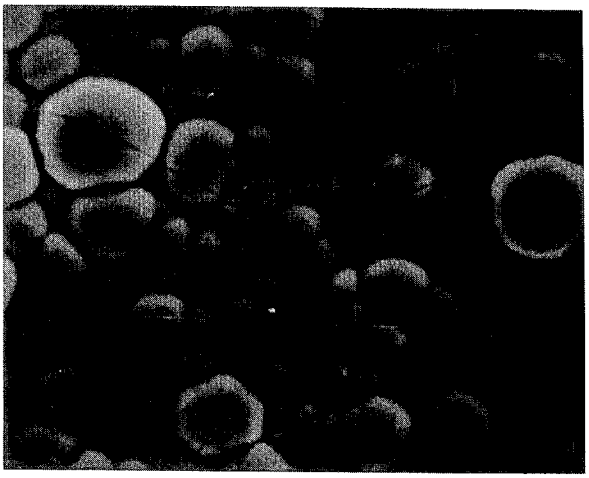
FIG. 3*e* shows the SEM microstructure of trivalent chromium as deposited from a bath at a temperature of 40° C. and a current density of 50 A/dm$^2$.
Figure 3C:
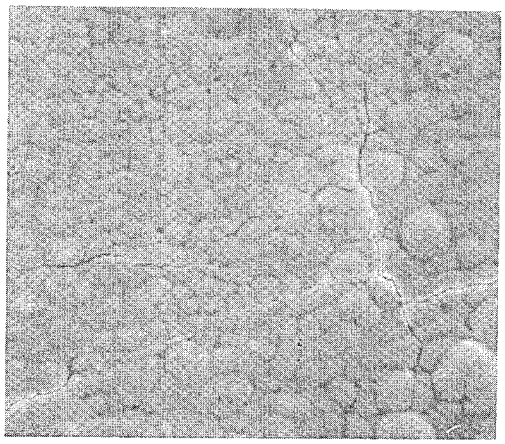
FIG. 3*c* shows the SEM microstructure (X1000) of trivalent chromium as deposited at a bath temperature of 40° C. and a current density of 30 A/dm$^2$.
Figure 4C:
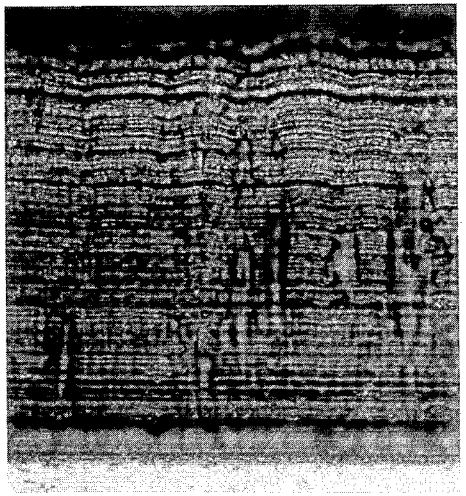
FIG. 4*c* is a cross-sectional view of trivalent chromium (X1000) deposited from a bath having a temperature of 40° C. and a current density of 30 A/dm$^2$.
Figure 4B:
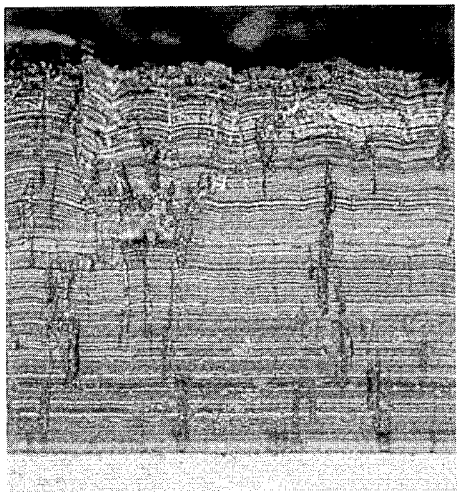
FIG. 4*b* is a cross-sectional view of trivalent chromium (X1000) deposited from a bath having a temperature of 30° C. using a current density of 30 A/dm$^2$.
Figure 4E:
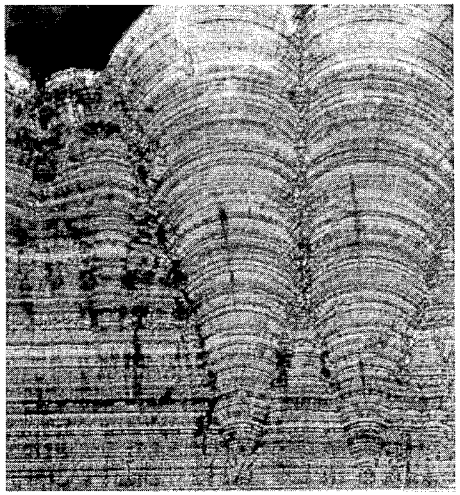
FIG. 4*e* is a cross-sectional of trivalent chromium (X1000) deposited from a bath having a temperature of 40° C. and a current density of 50 A/dm$^2$.
Figure 4A:
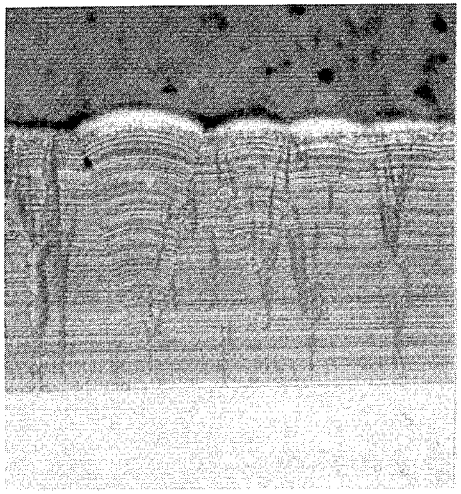
FIG. 4*a* is a cross-sectional view of trivalent chromium (X1000) deposited from a bath having a temperature of 20° C. using a current density of 30 A/dm$^2$.
Figure 4D:
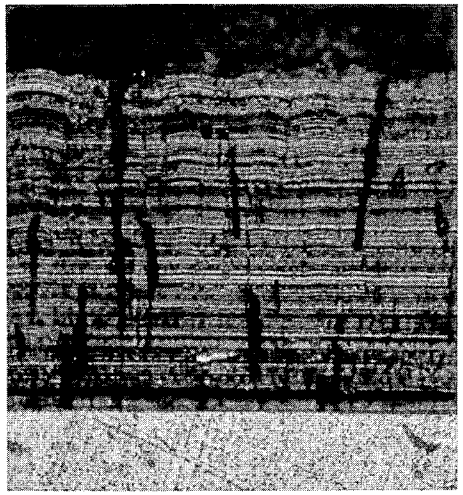
FIG. 4*d* is a cross-sectional view of trivalent chromium (X1000) deposited from a bath having a temperature of 40° C. and a current density of 40 A/dm$^2$.

The surface morphology as shown in FIG. 3*a*, *b* and *c* demonstrates the effect of changes of surface morphology with temperature (20°–40° C.). FIGS. 3*c*, *d* and *e* show the surface morphology as a function of current density (30–50 A/dm$^2$). All deposits have a microcrack pattern. Increasing the deposition temperature to 40° C. resulted in decreasing the crack density and increasing the current density to 50 A/dm$^2$ resulted in increasing the crack density. The nodular deposits appear in all deposits. The size and number of nodular deposits increase with temperature as well as current density. This kind of nodular deposit is believed to be a consequence of concentration polarization due to the high average current density used.

Cracks in the deposits are believed to be formed by the decomposition of chromium hydride. This decomposition results in a volume change, thereby restraining the deposits in the plane of the base metal and creating surface cracks. During the reaction, chromium hydride decomposes to chromium and hydrogen gas. This process seems to have created the cracks and holes shown in FIG. 3 and FIG. 4.

Figure 5:
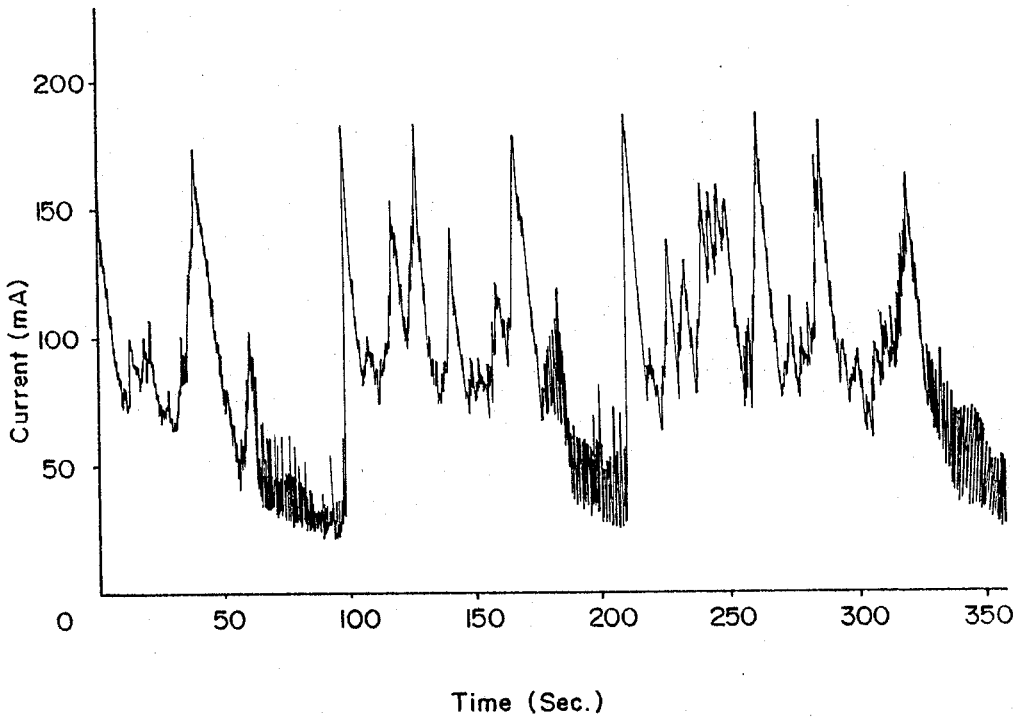
FIG. 5 is a graph showing the change in the potentiostatic measurement of current as a function of time at 2.5V.

Although all deposits show a nodular surface, the cross sectional view reveals the two dimensional laminar structure as shown in FIG. 4. The distance between laminae increases with increasing temperature and with decreasing current density. It is possible that a viscous cathode film forms and then is broken down in a periodic way as shown in FIG. 5. These phenomena take place more frequently at lower temperatures and higher current densities.

Figure 6A:
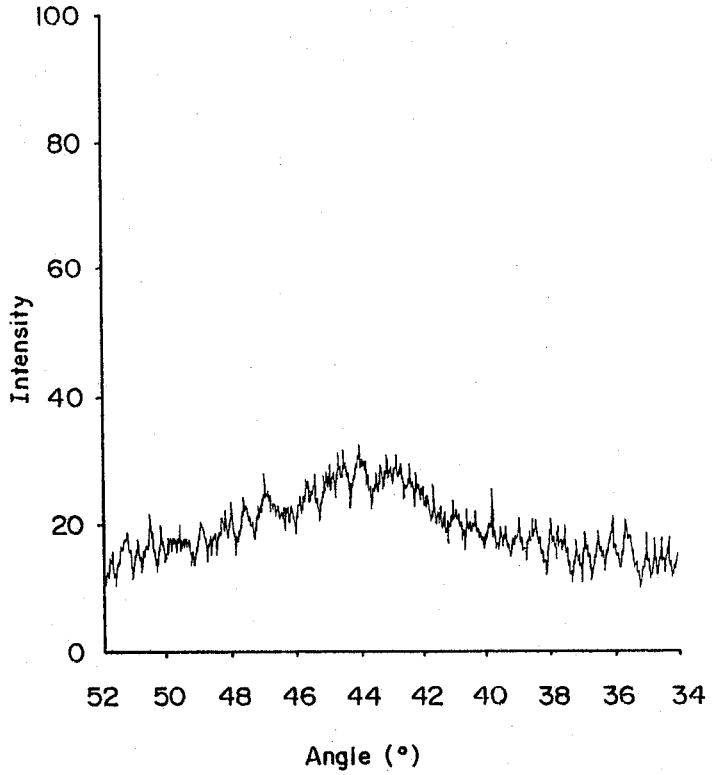
FIG. 6*a* is an x-ray diffraction line of a (110) plane of a trivalent chromium deposit.
Figure 6B:
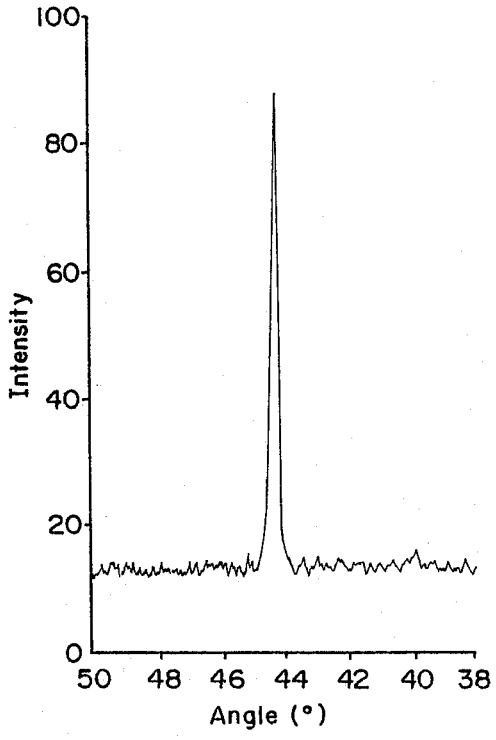
FIG. 6*b* is an x-ray diffraction line of a (110) plane of bulk chromium.

X-ray diffraction patterns of bulk chromium and as-deposited trivalent chromium are shown in FIG. 6. Electroplated hexavalent chromium has a (111) preferred orientation and BCC structure while trivalent chromium reveals only the (110) peak and not at the same position as aged bulk chromium as shown in FIG. 6 (B). Trivalent chromium was believed to have a simple cubic structure with (210) preferred orientation, but results in this work reveal the BCC structure with (110) preferred orientation.

The grain size of as-deposited chromium is about 30–35Å. These extremely fine grains in chromium deposits have been explained as resulting from hydride decomposition.

Microhardness and Wear Performance

Figure 7:
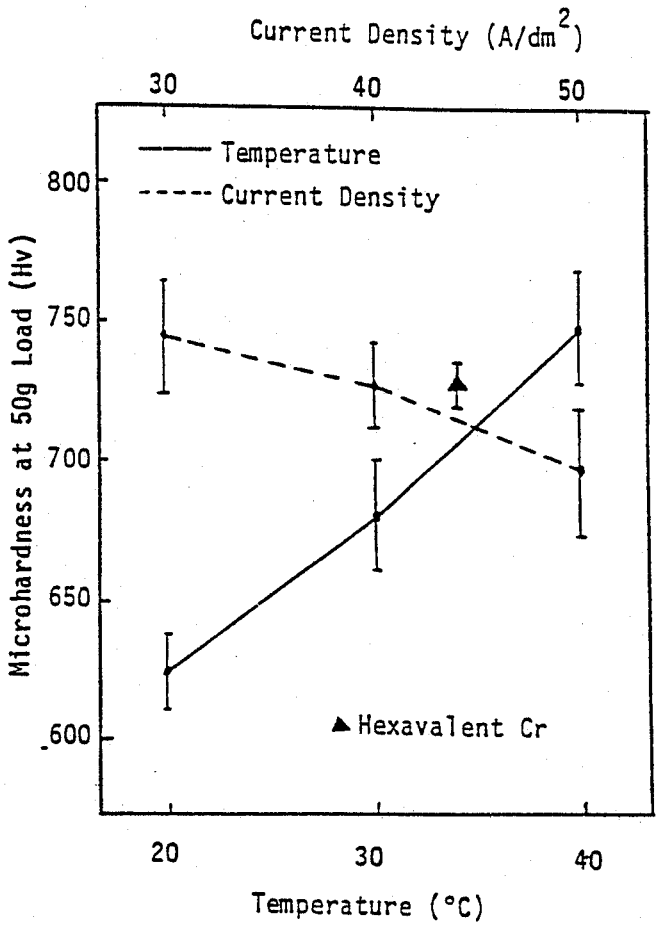
FIG. 7 is a graph showing the variation of microhardness with current density and bath temperature for the trivalent and hexavalent (55° C.–40 A/dm$^2$) chromium deposits.

The variation of microhardness with electrolyte temperature and the variation with current density of both trivalent and hexavalent chromium deposited at 55° C.–40 A/dm$^2$ are shown in FIG. 7.

The microhardness increases with the temperature and decreases with current density. The microhardness of trivalent chromium is nearly the same value as that of hexavalent chromium at higher current densities. The reason for the high hardness of electrodeposited chromium compared to that of bulk chromium is due to the hydrogen content, preferred orientation, internal stress and grain size. The hardness increases as the grain size decreases and also as the number of fine cracks increases.

The mechanism by which internal stress contributed to increases in the microhardness is not clear. However, internal stress as well as preferred orientation do have minor effects on hardness. The major parts of hardness increment is due to the fine grain size and internal stress. This is a well-known phenomenon.

The grain size of trivalent chromium was inferred from line width broadening and was found to be extremely small, about 30–35Å.

Figure 8:
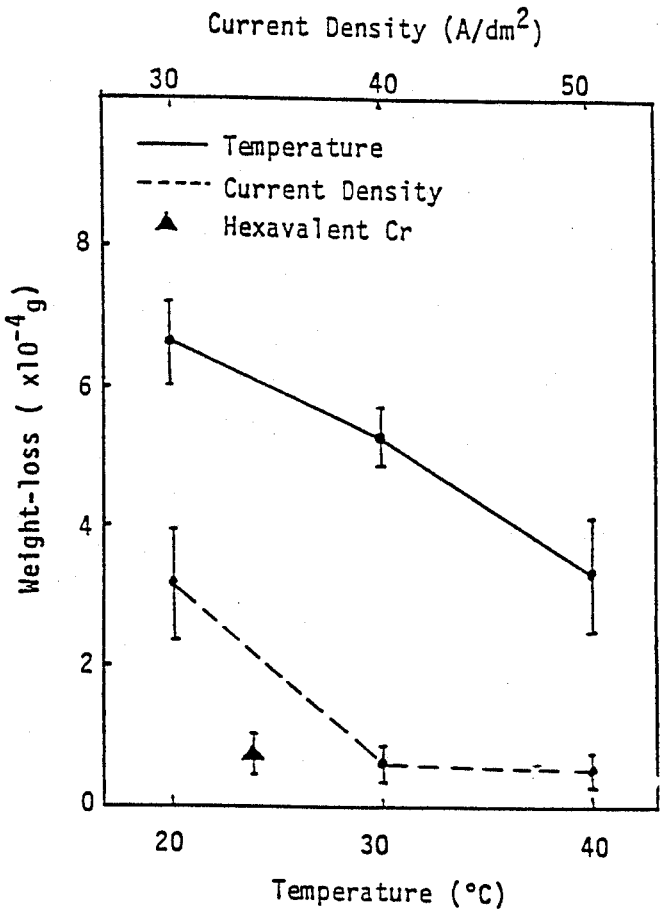
FIG. 8 is a graph of the variation of weight-loss with bath temperature and current density for the trivalent and hexavalent (55° C.–40 A/dm$^2$) chromium deposits.

The crack density, as shown in FIG. 3, decreases with increasing temperature and increases with current density. The higher the crack density, the lower the hardness is. It is probable that cracks in deposits are due to the relief of internal stress and therefore the microhardness increases with decreasing crack density. As shown in FIG. 4, the lower the hardness, the smoother the etched surface. The distance between laminae increases with increasing hardness. FIG. 8 shows the results of abrasive wear testing with a viscous solution of 10g 5μm$Al_2O_3$ and 5 g fumed silica mixed with water and adjusted to pH=4. The weight-loss decreases with increasing temperature and current density and has about the same magnitude, $10^{-4}$ g units: g/cm$^2$ as hexavalent chromium at higher current density. From this, it can be seen that weight-loss is affected by microhardness and structure. As is indicated in FIG. 3, 4 and 7, the temperature effect on the weight-loss is due to the hardness of deposit, and the current density effect on weight loss is due to the structure of the deposit, that is, the deposits have a nodular structure at higher current density.

CONCLUSION

1. Higher current efficiency, up to 35%, can be obtained using a glycolic acid process than with the citrate process. Thick coatings can be made.

2. All trivalent chromium deposits have cracks and nodules like hexavalent deposits, but the trivalent coatings have laminar structures.

3. The microhardness increases with increasing temperature and decreasing current density.

4. The wear rate in abrasive wear decreases with increasing temperature and current density. The mechanical properties of trivalent chromium obtained at higher current density are comparable to those of hexavalent deposits.

While the present invention has been described in its preferred embodiments, it is to be understood that the invention is not limited thereto, and may be otherwise embodied within the scope of the following claims.

What is claimed is:

1. An aqueous chromium electroplating bath, comprising a plating material source consisting essentially of $CrCl_3.6H_2O$; sodium citrate; glycolic acid; borate; at least one member selected from the group consisting of an alkali halide and ammonium halide; a wetting agent; and a buffer.

2. A bath according to claim 1, wherein said bath contains said alkali halide, and said alkali halide is KBr.

3. A bath according to claim 1, wherein said buffer is selected and present in an amount effective to maintain a pH of said bath between 1.8 and 4.9 during electrodeposition.

4. A bath according to claim 3, wherein said buffer maintains said pH at 4.0±0.5 during electrodeposition.

5. A bath according to claim 3, wherein said buffer is formic acid.

6. A bath according to claim 4, wherein said buffer is formic acid.

7. A bath according to claim 4, wherein said buffer is formic acid in concentrations between 5 and 75 g/l.

8. A bath according to claim 1, wherein the wetting agent comprises a polyethylene glycol ether of an alkylphenol.

9. A bath according to claim 1, wherein $CrCl_3.6H_2O$ is present in a concentration of between 50 and 150 g/l; KBr is present in a concentration of between 5 and 20 g/l; $H_3BO_3$ is present in a concentration of between 20 and 40 g/l; the wetting agent is present in a concentration of between 1 and 2 drops/1; glycolic acid is present in a concentration of between 25 and 50 g/l; said sodium citrate is present in a concentration of up to 100 g/l; and said buffer is present in an amount sufficient to maintain a pH of said bath at 4.0±0.5 during electrodeposition.

10. A method for the electrodeposition of chromium, comprising:

immersing a surface to be plated in an aqueous electrolyte bath containing: a plating material source consisting essentially of $CrCl_3.6H_2O$; sodium citrate; glycolic acid; borate; at least one member selected from the group consisting of an alkali halide and ammonium halide; a wetting agent; and a buffer; and passsing a current through the bath.

11. A method according to claim 10, wherein said buffer contains said alkali halide, and said alkali halide is KBr.

12. A method according to claim 10, wherein said buffer maintains a pH of the bath between 1.8 and 4.9.

13. A method according to claim 33, wherein said buffer maintains the pH of the bath at 4.0±0.5.

14. A method according to claim 12, wherein said buffer is formic acid in a concentration between 5 and 75 g/l.

15. A method according to claim 10, wherein the wetting agent comprises a polyethylene glycol ether of an alkyl phenol.

16. A method according to claim 11, wherein said $CrCl_3.6H_2O$ is present in a concentration of between 50 and 150 g/l; said KBr is present in a concentration of between 5 and 20 g/l; $H_3BO_3$ is present in a concentration of between 20 and 40 g/l; the wetting agent is present in a concentration of between 1 and 2 drops/1; said sodium citrate is present in a concentration of between 30 and 100 g/l; said glycolic acid is present in a concentration of between 25 and 50 g/l; and said buffer is present in an amount sufficient to maintain a pH of said bath at 4.0±0.5.

17. A method according to claim 10, wherein the current is a direct current and is applied at between 200 and 500 $mA/cm^2$.

18. A method according to claim 10, wherein the current is pulsed galvanostatic current at approximately 500 $mA/cm^2$ with a peak at 250 μs on and 750 μs off.

19. A method according to claim 10, wherein the chromium is deposited at a current density of between 30 and 50 $A/dm^2$.

20. A method according to claim 19, wherein the chromium is deposited at a current density of 40 $A/dm^2$.

21. A method according to claim 10, wherein the chromium deposited has a grain size of between 30 and 35Å.

22. A method according to claim 12, wherein said current is passed through said bath until said surface is plated in a thickness of at least 20 microns.

23. A method according to claim 12, wherein said current is passed through said bath until said surface is plated in a thickness of at least 50 microns.

24. A method according to claim 12, wherein said current is passed through said bath until said surface is plated in a thickness of at least 125 microns.

* * * * *